US006964219B2

(12) United States Patent
Gilon

(10) Patent No.: US 6,964,219 B2
(45) Date of Patent: Nov. 15, 2005

(54) BLAST RESISTANT PARTITIONS

(75) Inventor: Joel Gilon, Jerusalem (IL)

(73) Assignee: Electric Fuel (E.F.L.) Ltd., Jerusalem ( * ) Notice: Subject to any disclaimer, the term of this patent is extended or adjusted under 35 U.S.C. 154(b) by 0 days.

(21) Appl. No.: 10/697,341

(22) Filed: Oct. 30, 2003

(65) Prior Publication Data

US 2004/0089143 A1 May 13, 2004

(30) Foreign Application Priority Data

Oct. 31, 2002 (IL) ..... 152572

(51) Int. Cl.[7] ..... F41H 7/00

(52) U.S. Cl. ..... 89/36.08; 89/36.07; 89/36.11; 296/24.46; 244/121

(58) Field of Search ..... 89/36.07, 36.08, 89/36.09, 36.11, 36.12; 296/24.46, 24.42, 296/24.43; 244/120, 121, 119, 118.5

(56) References Cited

U.S. PATENT DOCUMENTS

| | | | | |
|---|---|---|---|---|
| 1,433,708 | A * | 10/1922 | Fenton | 89/36.08 |
| 1,501,790 | A * | 7/1924 | McClay et al. | 180/318 |
| 1,632,360 | A * | 6/1927 | Wilson | 296/24.37 |
| 1,717,533 | A * | 6/1929 | Ward | 244/119 |
| 2,185,209 | A * | 1/1940 | Love | 296/24.37 |
| 2,320,596 | A * | 6/1943 | Henney | 62/244 |
| 3,510,164 | A * | 5/1970 | Setina | 296/24.46 |
| 4,309,055 | A * | 1/1982 | Law | 296/63 |
| 4,438,677 | A * | 3/1984 | Spotzl et al. | 89/36.13 |
| 4,448,107 | A * | 5/1984 | Kotai et al. | 89/36.13 |
| 4,621,856 | A | 11/1986 | McKenzie | |
| 4,864,913 | A * | 9/1989 | Grunewald et al. | 89/34 |
| 5,249,534 | A * | 10/1993 | Sacks | 109/24 |
| 5,482,230 | A * | 1/1996 | Bird et al. | 244/121 |
| 5,716,026 | A * | 2/1998 | Pascasio et al. | 244/118.6 |
| 5,769,257 | A * | 6/1998 | Fleisher et al. | 220/1.5 |
| 5,811,719 | A * | 9/1998 | Madden, Jr. | 89/36.08 |
| 5,866,839 | A * | 2/1999 | Ohayon | 89/36.08 |
| 5,921,504 | A * | 7/1999 | Elizondo | 244/140 |
| 6,056,239 | A * | 5/2000 | Cantu et al. | 244/118.6 |
| 6,286,882 | B1 * | 9/2001 | Rastetter | 296/24.41 |
| 2003/0047648 | A1 * | 3/2003 | Batt et al. | 244/118.5 |

FOREIGN PATENT DOCUMENTS

| | | | |
|---|---|---|---|
| DE | 198 38 236 | A1 * | 3/2000 |
| EP | 1 110 861 | A1 * | 6/2001 |
| GB | 2 275 281 | | 8/1994 |
| JP | 3-16838 | * | 1/1991 |

* cited by examiner

*Primary Examiner*—Stephen M. Johnson
(74) *Attorney, Agent, or Firm*—Bachman & LaPointe, P.C.

(57) ABSTRACT

The invention provides an array of blast-resistant partitions arranged to subdivide a predetermined space into a multiplicity of interconnected subspaces and thereby to substantially confine an explosive blast to one or more of the subspaces while protecting the remaining subspaces in the predetermined space.

6 Claims, 1 Drawing Sheet

BLAST RESISTANT PARTITIONS

BACKGROUND OF THE INVENTION

The present invention relates to the protection of persons proximate to an explosion.

More particularly, the invention provides an array of partitions, and a method, arranged to attenuate blast from an explosion on one side of a partition and thereby protect or at least reduce the severity of injury of people on the far side of said partition(s).

A known terrorist tactic used against populations in Colombia, Indonesia, Lebanon, Ireland, Israel, the Philippines, Northern Spain and other countries is to detonate an explosive device among a crowd of people, the aim being to kill and injure as many as possible so as to draw attention—if not sympathy—to their cause or hatreds. Such explosion may be set off by a timing device, radio telephone or manually in the case of a suicide bomber. Security services have difficulty in preventing such attacks, due to the problems of identifying a terrorist among many thousands of other people going about their daily activities. Furthermore, it is not possible economically to place a security guard in every bus, bus shelter, school, kindergarten, large building, store and street where people congregate, nor is it possible to know in advance when and where attacks will be executed.

In Israel, public transportation vehicles in particular have been the subject of many attacks. A Hebrew language newspaper "BASHOVUA" 17 Oct. 2002, in an article "Drivers in the line of fire" reports that between 1948 and 2002 there have been 39 attacks against buses causing 270 fatalities and many more wounded and disabled, some for life.

Well known in the prior art are taxis fitted with a partition separating the passenger and driver compartment. The partition is intended primarily to prevent the passenger(s) from attacking the driver, and do not relate to explosive blast protection.

Hammerton in UK Patent Application 2 275 281 discloses a stud partition which is claimed to be resistant to bullets or bomb blast. The partition is intended for installation in or around a building. Because of its weight and volume the partition is unsuitable for use in vehicles.

A removable partition intended for vans and station wagons is disclosed by Mckenzie in U.S. Pat. No. 4,621,856. The panel has a bowed forward configuration and is intended primarily to prevent persons or objects hitting the driver in the event of emergency braking or of a collision.

In practical terms advance information can prevent only some but not all attacks. What can be done is to arrange areas where attacks are likely in a manner to reduce casualties resulting from explosive charges. A patent search failed to produce any relevant documents on the subject of applying such ideas to public transportation vehicles. In particular nothing was found relating to the reduction of casualties in passenger bus bombings.

It is therefore one of the objects of the present invention to fill a gap in prior art blast protective devices and to provide a partition array to reduce casualties in case of an explosion in a previously defined space.

It is a further object of the present invention to provide a blast-protective partition array for passenger buses, while continuing to allow free movement along the length of the vehicle.

SUMMARY OF THE INVENTION

The present invention achieves the above objects by providing an array of blast-resistant partitions arranged to subdivide a predetermined space into a multiplicity of interconnected subspaces and thereby to substantially confine an explosive blast to one or more of said subspaces while protecting the remaining subspaces in said predetermined space.

In a preferred embodiment of the present invention there is provided an array of blast-resistant partitions wherein said predetermined space is the interior of a public transportation vehicle.

In a further preferred embodiment of the present invention there is provided a method of substantially confining an explosive blast comprising a) providing an array of blast-resistant partitions;

b) positioning said partitions to subdivide a predetermined space into a multiplicity of interconnected spaces; and c) firmly anchoring said partitions to an adjacent structure whereby an explosive blast in one or more of said subspaces is substantially confined thereto and said partitions protect the remaining subspaces in said predetermined space.

In especially preferred embodiments of the present invention, said partitions will extend upwardly from the floor surface to a height of about 2 meters, i.e. to protect standing people.

Yet further embodiments of the invention will be described hereinafter.

It will thus be realized that the novel arrangement of the present invention serves also to deter those wishing to kill and injure as many people as possible. A terrorist seeing the partitions is likely to understand their purpose and will then spend time looking for alternative targets—such time increasing the probability of being captured by security forces.

The partition of the present invention will reduce fatalities and injuries even when a large explosive charge is detonated either at the front or the back of the bus, as happened Oct. 21, 2002, when a passenger bus was rammed in the rear by a vehicle holding 100 kg of explosives at the Karkur Junction. Injury reduction also eases the task of rescuing passengers and allowing at least some of the lightly injured to escape by their own efforts before the possible outbreak of fire.

Wherever the partitions are used, space needs to be allocated to enable people to enter and leave. While in some applications the panel could be hinged as a door, usually this is impractical and the subspaces are open on one side to provide passage. Thus the blast is attenuated in the subspaces, even though absolute protection is not provided. However a high degree of protection against flying objects is ensured in all subspaces not directly open to the source of an explosion.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a fragmented elevational view of a preferred embodiment of the array according to the invention wherein the protected space is the inside of a bus; and FIG. 2 is a perspective view of a preferred blast-resistant panel.

DETAILED DESCRIPTION

Figure 1:
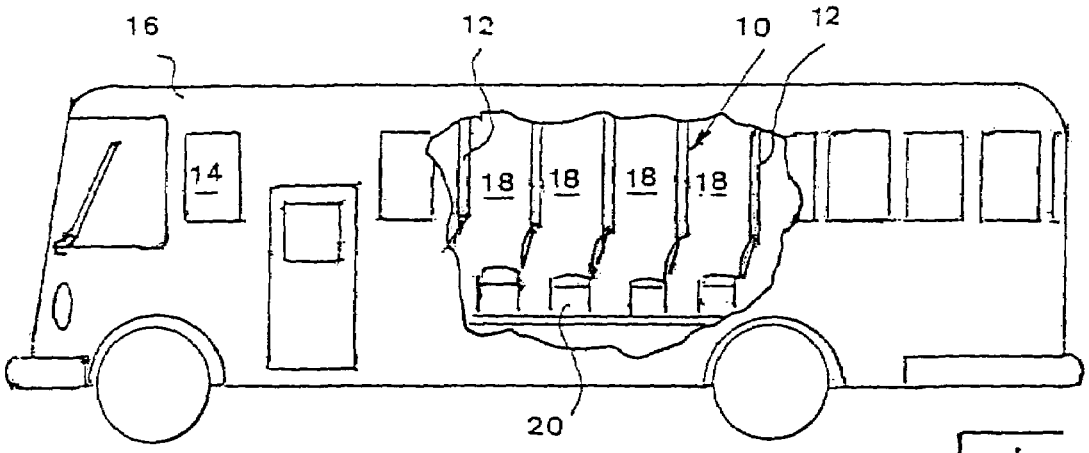

There is seen in FIG. 1 an array 10 of blast-resistant partitions 12 extending upwardly to slightly above standard human height and arranged to subdivide a predetermined space 14, which in the present embodiment is the interior of a public transportation vehicle such as the bus 16 seen in the figure.

The partitions 12 divide the inside of the vehicle into a multiplicity of interconnected subspaces 18. Each row of seats 20, after partitions 12 have been added, forms two subspaces 18, one on each side of an aisle running the length of the bus 16.

While not shown partitions can also be positioned in the aisles, where space permits, such as opposite the inner exit doors.

An explosive blast in subspace 18*a* is substantially confined therein, thereby protecting the remaining subspaces 18 in the bus 16, and reducing the risk of serious injury to passengers occupying the remaining subspaces 18. The subspace 18 also protects its occupants from flying solid objects, whether part of the explosive charge or originating in the vehicle.

Figure 2:
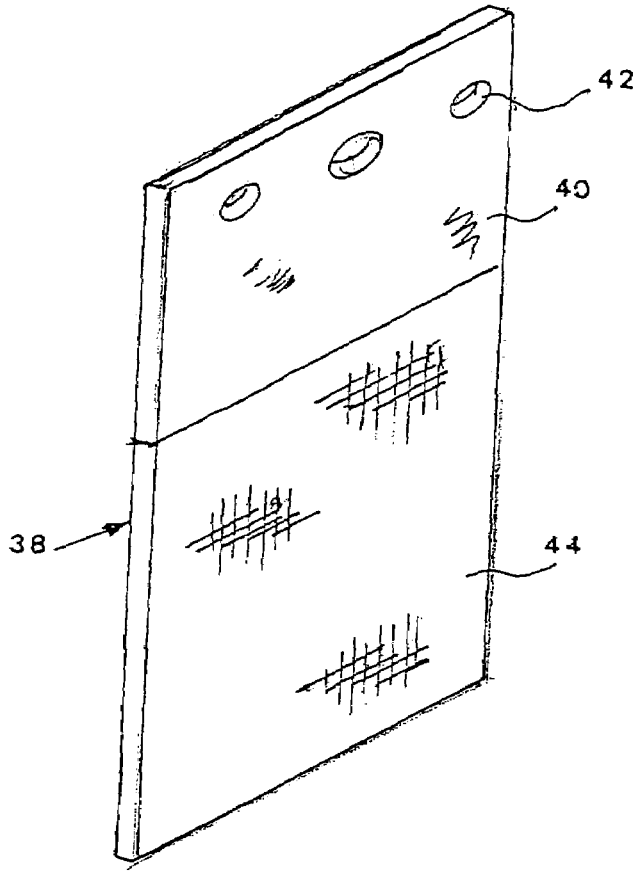

Referring now to FIG. 2, there is depicted a single partition 38.

The partition is provided with apertures 42 to attenuate blast pressure in the subspace wherein the blast occurs while air pressure rise in the remaining subspaces is within a limit avoiding injury of persons located therein.

Advantageously the upper portion 40 of the partition 38 is made of transparent polycarbonate resin.

Where the partition 38 is to be attached in a vehicle, as for example was seen in FIG. 1, it is preferable that those parts of the partition not requiring to be transparent 44 be made of aramide fibers such as Kevlar™, providing a high strength/weight ratio.

For non-mobile applications there are no weight limits and the lower portion of the partition is made of conventional materials, for example steel-reinforced concrete.

Also part of the present invention is a method of substantially confining an explosive blast comprising the following steps:

A) Providing an array of blast-resistant partitions

B) Positioning the partitions to subdivide a predetermined space into a multiplicity of interconnected subspaces; and C) firmly anchoring the partitions to an adjacent structure.

An explosive blast in one or more of the subspaces is substantially confined thereto and the partitions protect the remaining subspaces in the predetermined space.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A public transportation vehicle for transporting passengers comprising:

an interior of a public transportation vehicle for accommodating passengers to be transported; and blast-resistant protection means arranged in the interior of the vehicle for confining an explosive blast and protecting at least some of the passengers, said blast-resistant protection means comprising:

an array of partition means arranged in the interior of the vehicle to subdivide the interior into a plurality of interconnected subspaces for substantially confining an explosive blast to at least one subspace for protecting the passengers situated in the remaining subspaces, the array of partition means comprising at least six spaced-apart blast-resistant panels, fixedly attached to and extending inwardly from inner surfaces of the vehicle body and positioned within the interior of the vehicle for separating groupings of passengers from each other, each panel comprises a transparent portion, wherein at least the transparent portion is provided with a plurality of apertures to attenuate blast pressure in the subspace wherein the blast occurs while air pressure rise in the remaining subspaces is within a limit avoiding injury of persons located therein and provide protection against flying objects in the subspaces not directly open to the source of the explosive blast.

2. A vehicle according to claim 1, wherein at least a part of the panel is made of transparent polycarbonate.

3. A vehicle according to claim 2, wherein at least a part of the panel is made of aramide fibers.

4. A vehicle according to claim 1, wherein the public transportation vehicle is a bus.

5. A vehicle according to claim 1, wherein each panel further comprises a reinforced portion.

6. A method for confining an explosive blast of a public transportation vehicle comprising:

a) providing a public transportation vehicle having an interior space for accommodating passengers;

b) locating at least six blast-resistant panels in the interior of the vehicle in a spaced-apart manner so as to subdivide the interior into a plurality of interconnected subspaces for substantially confining an explosive blast to at least one subspace for protecting passengers situated in the remaining subspaces; and c) anchoring the panels to an adjacent structure in the interior of the vehicle wherein each panel comprises a transparent portion, wherein at least the transparent portion is provided with a plurality of apertures to attenuate blast pressure in the subspace wherein the blast occurs while air pressure rise in the remaining subspaces is within a limit avoiding injury of persons located therein and provide protection against flying objects in the subspaces not directly open to the source of the explosive blast.

* * * * *